US005986415A

United States Patent [19]

Nishihara

[11] Patent Number: 5,986,415

[45] Date of Patent: Nov. 16, 1999

[54] LINEAR ELECTRON ACCELERATOR

[75] Inventor: Susumu Nishihara, Tokyo, Japan

[73] Assignee: Mitsubishi Denki Kabushiki Kaisha, Tokyo, Japan

[21] Appl. No.: 09/016,787

[22] Filed: Jan. 30, 1998

[30] Foreign Application Priority Data

Aug. 27, 1997 [JP] Japan ..... 9-231206

[51] Int. Cl.[6] ..... H05H 9/00

[52] U.S. Cl. ..... 315/505; 315/507

[58] Field of Search ..... 315/500, 506, 315/507, 5.41, 5.42, 505; 313/359.1, 361.1

[56] References Cited

U.S. PATENT DOCUMENTS

| | | | |
|---|---|---|---|
| 4,641,103 | 2/1987 | Madey et al. . | |
| 4,703,228 | 10/1987 | West | 315/149 |
| 4,998,073 | 3/1991 | Miyata et al. | 315/500 |
| 5,029,259 | 7/1991 | Nishihara . | |
| 5,097,178 | 3/1992 | Nishihara . | |
| 5,121,031 | 6/1992 | Nishihara . | |
| 5,132,593 | 7/1992 | Nishihara . | |

FOREIGN PATENT DOCUMENTS

| | | |
|---|---|---|
| 6-243776 | 9/1994 | Japan . |
| 7-335400 | 12/1995 | Japan . |
| 7335400 | 12/1995 | Japan . |

*Primary Examiner*—Edward P. Westin
*Assistant Examiner*—Nikita Wells
*Attorney, Agent, or Firm*—Rothwell, Figg, Ernst & Kurz

[57] ABSTRACT

In order to obtain a linear electron accelerator having enhanced beam performance, a thermion emitting face 11 of a cathode 10 is enclosed by carbon 17. Consequently, distribution of an electric field 30 for leading out electrons becomes parallel with the thermion emitting face 11. Therefore, electron beams emitted from the thermion emitting face 11 become streamlines parallel with each other. Thus, the beam performance of the linear electron accelerator can be enhanced.

8 Claims, 11 Drawing Sheets

LINEAR ELECTRON ACCELERATOR

BACKGROUND OF THE INVENTION

1. Field of the Invention

The present invention relates to an electron linear accelerator, and more particularly to an electron linear accelerator having enhanced electron beam focusing properties.

2. Description of the Related Art

An electron linear accelerator has been disclosed in U.S. Pat. No. 4,641,103 and the like. FIG. 11 shows an example of the electron linear accelerator according to the prior art.

In FIG. 11, a cathode for emitting thermions is provided on a cathode support cylinder 15. The thermions are led out to an RF electron gun cavity 12 in a direction of an electron accelerating tube 14 by a microwave generated from an RF source 13.

FIG. 12 is an enlarged view showing the vicinity of a tip of the cathode support cylinder 15 shown in FIG. 11. In FIG. 12, the tip of the cathode support cylinder 15 is provided with a cathode 10 for emitting thermions. The cathode 10 is heated by a cathode heater 16. The thermions are emitted from a face 11 of the heated cathode 10. The RF electron gun cavity 12 is provided ahead of the thermion emitting face 11 of the cathode 10. An electric field 30 of the microwave generated from the RF source 13 for leading a thermion 25 in the direction of the accelerating tube 14 exists in the RF electron gun cavity 12. The thermion 25 is led out of the vicinity of the thermion emitting face 11 of the cathode 10 by the electric field 30, and is incident on the accelerating tube 14 through an RF electron gun and is accelerated to a high energy.

In such an electron linear accelerator according to the prior art, however, distribution of the electric field 30 for leading out the thermion 25 in the vicinity of the cathode 10 easily becomes uneven as shown in FIG. 12. In other words, the distribution of the electric field 30 is not parallel with the thermion emitting face 11. For this reason, the thermions 25 are not moved in parallel with each other toward the accelerating tube 14 (FIG. 11) so that an electron beam diverges. Therefore, beam performance such as an electron emittance or focusing properties of the electron beam are deteriorated.

SUMMARY OF THE INVENTION

In consideration of the problems of the prior art, it is an object of the present invention to provide an electron linear accelerator in which distribution of a leading electric field is made uniform in the vicinity of a cathode and beam performance is enhanced.

In order to attain the above-mentioned object, a first aspect of the present invention is directed to an electron linear accelerator comprising an RF electron gun including a cathode which has a thermion emitting face wherein thermions emitted from the cathode are led out in a direction of an accelerating tube by an electric field formed by a microwave, electric field distribution adjusting means which has carbon enclosing the thermion emitting face on almost the same level with the thermion emitting face and which makes the distribution of the electric field formed by the microwave uniform, carbon heaters interposing an end of the cathode in contact therewith and heating the cathode directly, and wherein the electric field distribution adjusting means is interposed between the end of the cathode and the carbon heater.

A second aspect of the present invention is directed to an electron linear accelerator comprising an RF electron gun including a cathode which has a thermion emitting face wherein thermions emitted from the cathode are led out in a direction of an accelerating tube by an electric field formed by a microwave, electric field distribution adjusting means which has carbon enclosing the thermion emitting face on almost the same level with the thermion emitting face and which makes distribution of the electric field formed by the microwave uniform, and wherein a surface of the carbon is formed so as to enclose the thermion emitting face and to have a tapered shape.

A third aspect of the present invention is directed to an electron linear accelerator comprising an RF electron gun including a cathode which has a thermion emitting face wherein thermions emitted from the cathode are led out in a direction of an accelerating tube by an electric field formed by a microwave, electric field distribution adjusting means which has carbon enclosing the thermion emitting face on almost the same level with the thermion emitting face and which makes distribution of the electric field formed by the microwave uniform, and wherein the cathode has a photoelectron emitting face which is excited by light to emit photoelectrons in place of the thermion emitting face.

DESCRIPTION OF THE PREFERRED EMBODIMENTS

Preferred embodiments of the present invention (hereinafter referred to as embodiments) will be described below with reference to the drawings.

FIRST EMBODIMENT

Figure 1A:
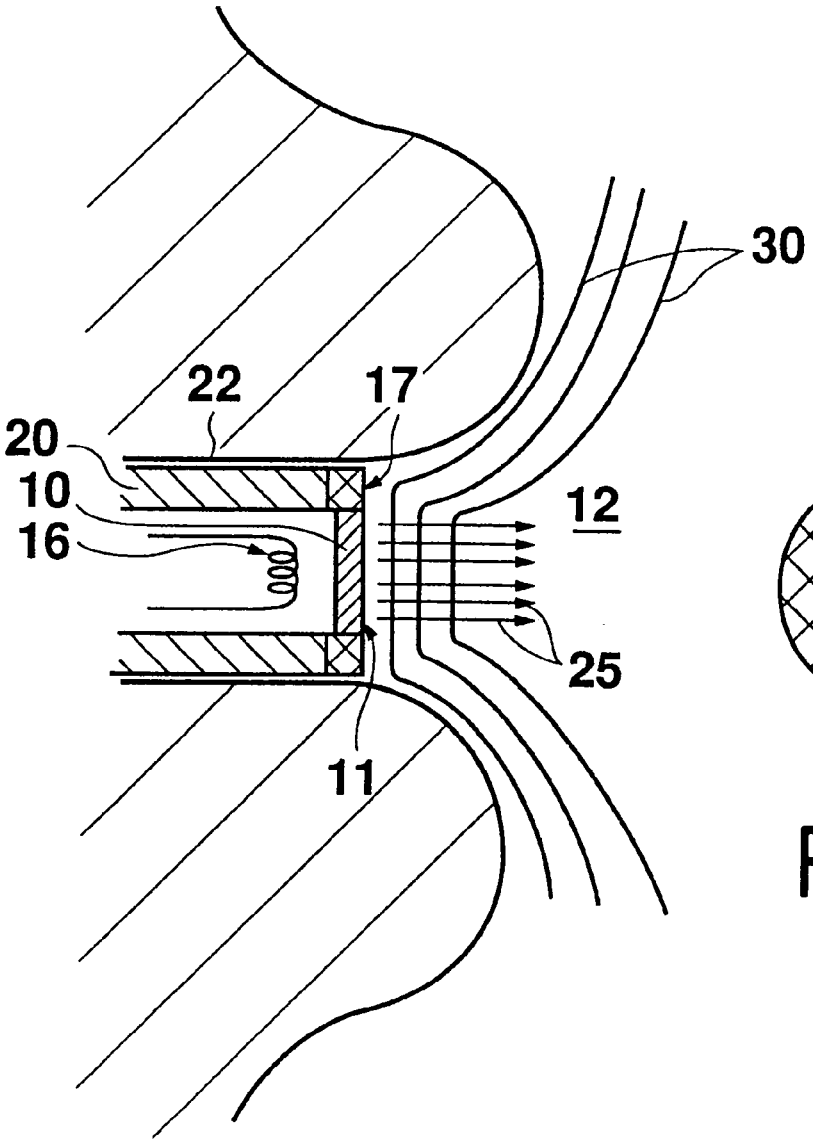
FIG. 1(*a*) is a cross-sectional view showing an electron linear accelerator according to a first embodiment of the present invention, and FIG. 1(*b*) is a front view showing a cathode.
Figure 1B:
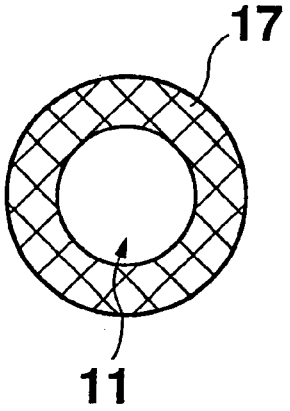

FIGS. 1(*a*) and 1(*b*) show a first embodiment of the present invention. Since the same members have the same reference numerals as in the prior art shown in FIGS. 11 and 12, their description will be omitted.

FIG. 1(*a*) is a cross-sectional view showing a portion surrounding a cathode 10 of an electron linear accelerator according to the present embodiment, and FIG. 1(*b*) is a view showing the cathode 10 seen from a forward position, that is, in a direction of an RF electron gun cavity 12.

Figure 11:
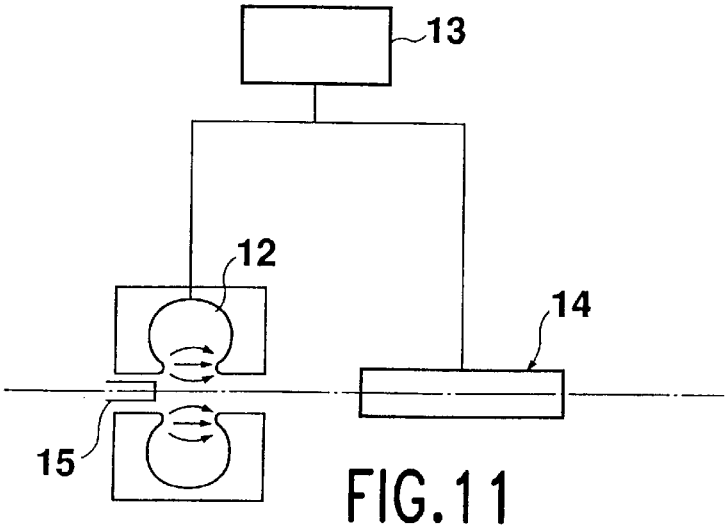
FIG.11 PRIOR ART
FIG. 11 is a view showing a structure of an electron linear accelerator according to the prior art.
Figure 12:
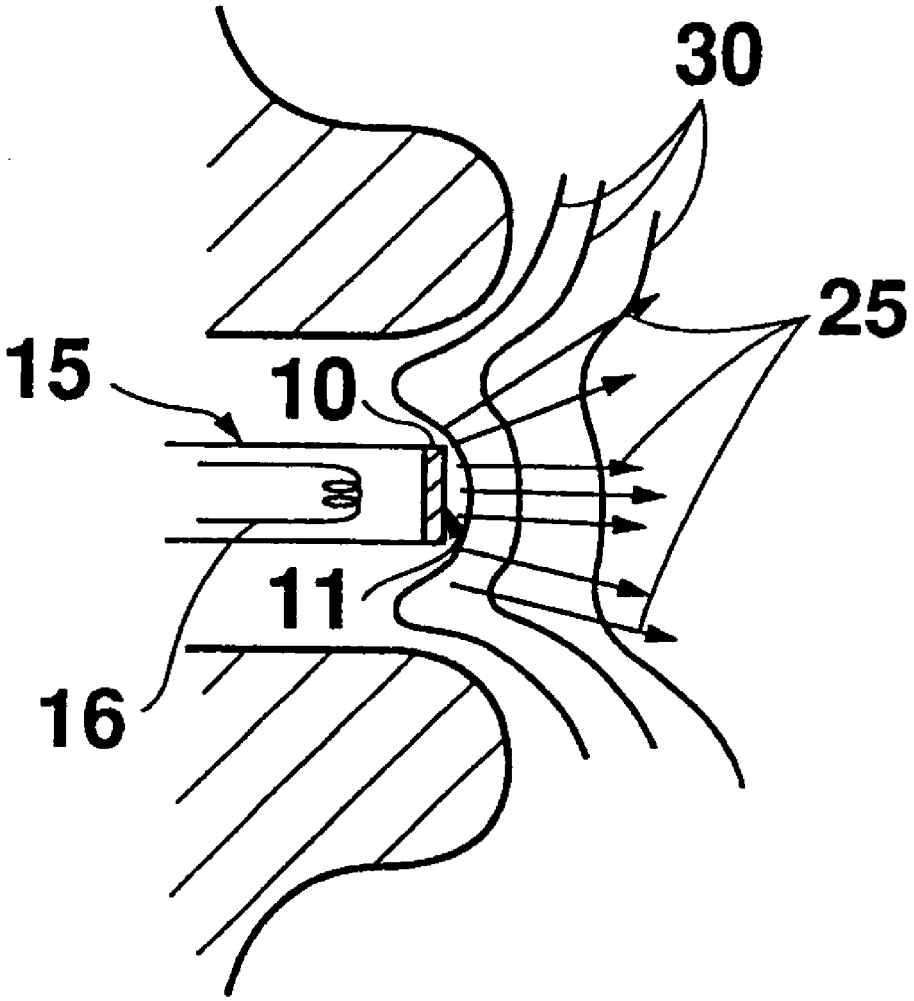
FIG. 12 PRIOR ART
FIG. 12 is an enlarged view showing the vicinity of a tip of a cathode support cylinder of the electron linear accelerator shown in FIG. 11.

In FIG. 1(*a*), the cathode 10 is heated by an indirect cathode heater 16 to emit a thermion 25 from a thermion emitting face 11. An electric field 30 for leading out the thermion 25 in a direction of the accelerating tube 14 shown in FIG. 11 is formed in the RF electron gun cavity 12 provided ahead of the thermion emitting face 11. Consequently, the thermion 25 emitted from the thermion emitting face 11 is led to the accelerating tube 14. An electric field distribution adjusting cylinder 20 which acts as electric field distribution adjusting means for uniformly adjusting distribution of the electric field 30 is inserted in an internal wall 22 of the RF electron gun cavity 12. Carbon 17 is formed on a tip of the electric field distribution adjusting cylinder 20. A surface of the carbon 17 is on almost the same level with the thermion emitting face 11.

Figure 2A:
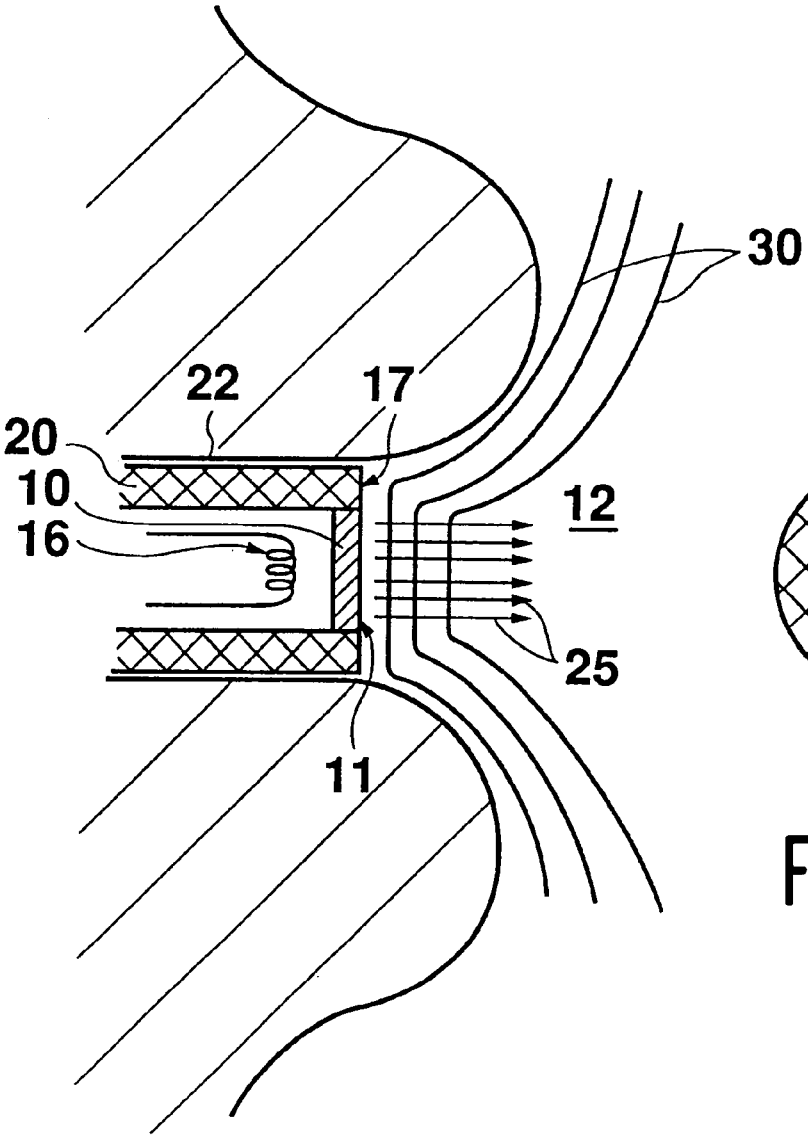
FIG. 2(*a*) is a cross-sectional view showing a variant of the electron linear accelerator according to the first embodiment of the present invention, and FIG. 2(*b*) is a front view showing a cathode.
Figure 2B:
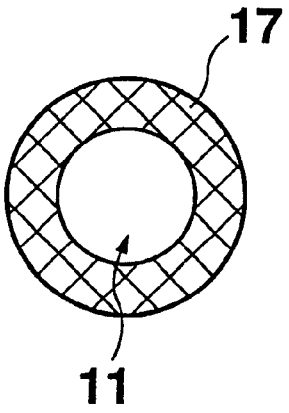

In the present embodiment, the electric field distribution adjusting cylinder 20 is formed of an electric conductor. However, the electric field distribution adjusting cylinder 20 may be formed of carbon integrally with the carbon 17 provided on the tip thereof as shown in FIGS. 2(*a*) and 2(*b*).

The present embodiment is characterized in that the periphery of the thermion emitting face 11 of the cathode 10 is enclosed by the carbon 17 as shown in FIG. 1(*b*).

By the above-mentioned structure according to the present embodiment, the distribution of the electric field 30 formed in the RF electron gun cavity 12 for leading out the thermion 25 is uniform in the region in front of the thermion emitting face 11 of the cathode 10. As shown in FIG. 1(*a*), the distribution of the electric field 30 is parallel with the thermion emitting face 11. For this reason, a streamline of the thermion 25 emitted from the thermion emitting face 11 does not diverge. Thus, an electron beam is a streamline parallel in the direction of the accelerating tube 14 shown in FIG. 11.

As described above, an electron linear accelerator having enhanced beam performance can be obtained.

SECOND EMBODIMENT

Figure 3A:
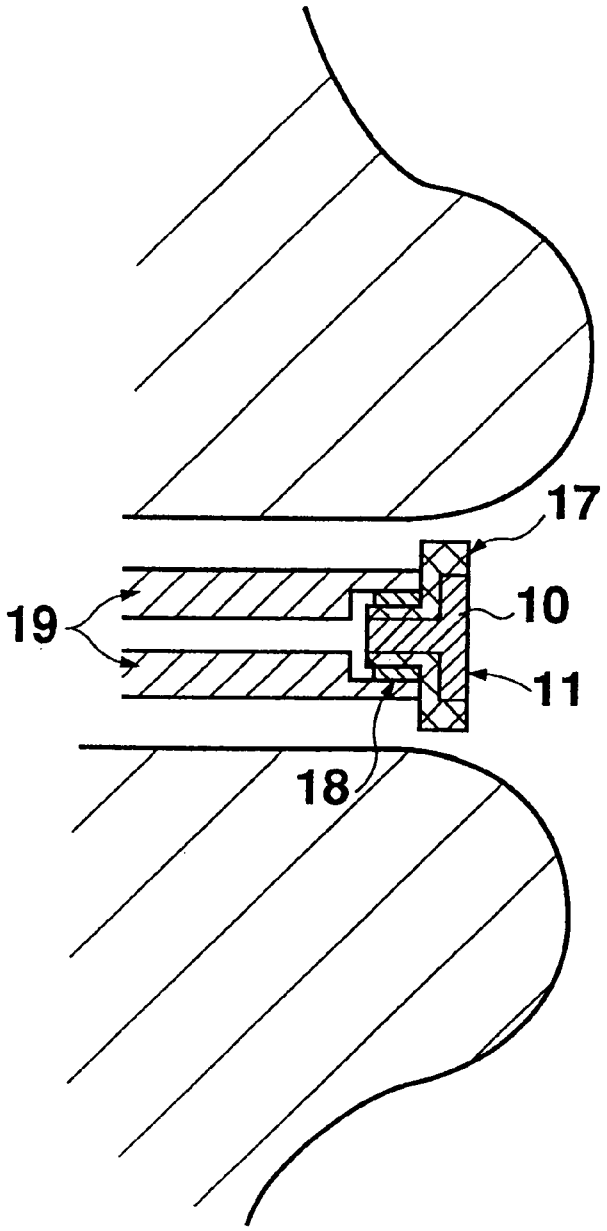
FIG. 3(*a*) is a cross-sectional view showing an electron linear accelerator according to a second embodiment of the present invention, and FIG. 3(*b*) is a front view showing a cathode.
Figure 3B:
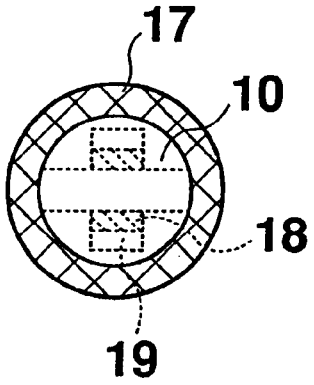

FIGS. 3(*a*) and 3(*b*) show a second embodiment of the present invention.

While the cathode 10 has been indirectly heated by the indirect cathode heater 16 in the first embodiment, it is directly heated by a pair of carbon heaters 18 in the present embodiment.

As shown in FIG. 3(*a*), an end of the cathode 10 opposite to a thermion emitting face 11 has a rectangular shape. A rectangular portion is longitudinally interposed within the carbon 17. The carbon heaters 18 are fixedly interposed between cathode support bars 19. In this case, the carbon 17 is interposed between the rectangular portion of the end of the cathode 10 and the carbon heater 18.

A state seen from the thermion emitting face 11 side is shown in FIG. 3(*b*). In FIG. 3(*b*), since the carbon heater 18 and the cathode support bar 19 are concealed behind the cathode 10, they are shown in broken lines. The carbon heater 18 is referred to as a pyrocarbon which is crystallized and generates resistance in a direction of a current flow to generate heat. On the other hand, the carbon 17 enclosing the cathode 10 is referred to as an isotropic carbon which does not generate heat even if a current flows. In the case where the cathode is $LaB_6$, it easily reacts to other substances. Therefore, if the cathode should be kept, the carbon is used.

In the present embodiment, a filament is not used. Therefore, reliability can be enhanced without problems such as tearing of the filament and the like. Compared with the indirect heater, the number of parts can be further reduced.

THIRD EMBODIMENT

Figure 4A:
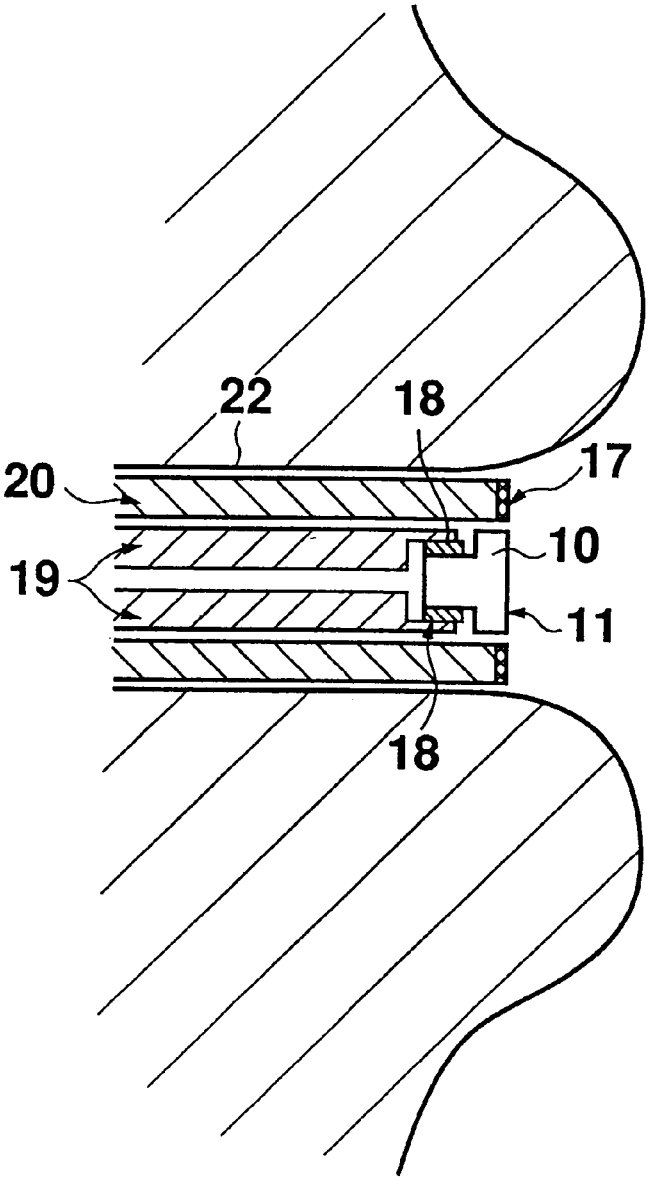
FIG. 4(*a*) is a cross-sectional view showing an electron linear accelerator according to a third embodiment of the present invention, and FIG. 4(*b*) is a front view showing a cathode.
Figure 4B:
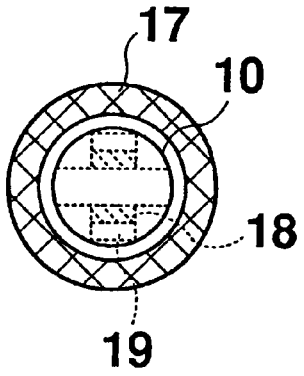

FIGS. 4(*a*) and 4(*b*) show a third embodiment of the present invention. In the same manner as in the second embodiment, a cathode 10 is longitudinally interposed between carbon heaters 18.

In the present embodiment, an electric field distribution adjusting cylinder 20 is formed of an insulator, and carbon 17 enclosing a thermion emitting face 11 is formed, by evaporation, on a surface of a tip of the electric field distribution adjusting cylinder 20.

By using the electric field distribution adjusting cylinder 20 formed of the insulator, it is not necessary to insulate a cathode support bar 19 from an internal wall 22 of an RF electron gun cavity 12, and consequently manufacture can be performed easily.

A method for forming the carbon 17 is not restricted to evaporation. A film formed by sputtering or the like may be used for the carbon 17.

FOURTH EMBODIMENT

Figure 5A:
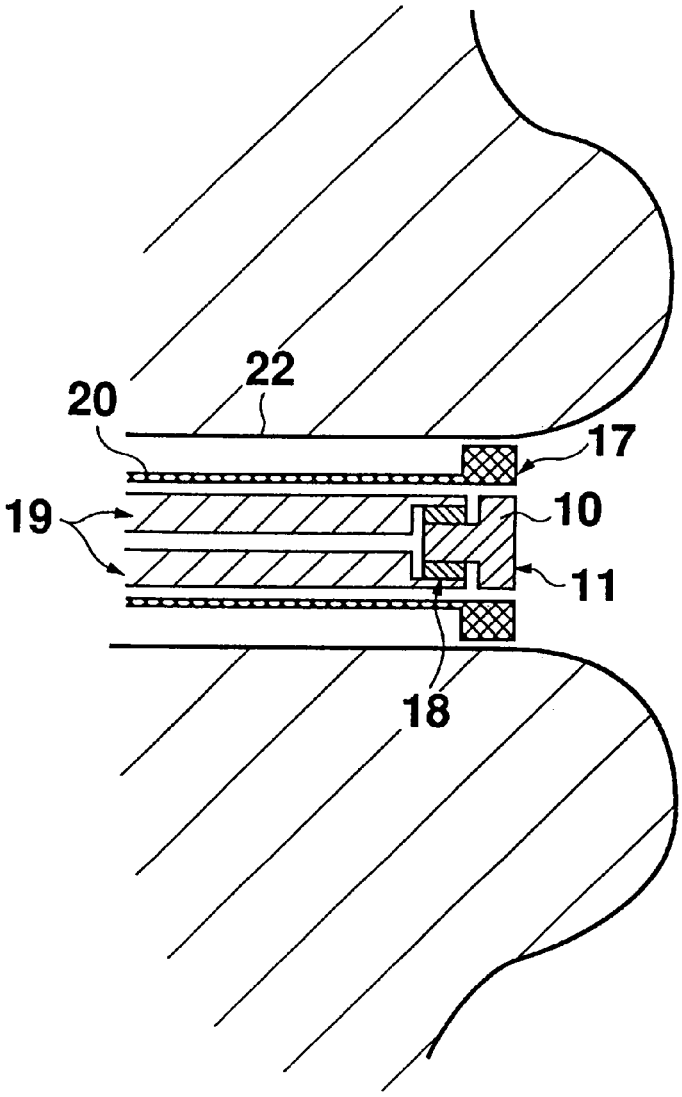
FIG. 5(*a*) is a cross-sectional view showing an electron linear accelerator according to a fourth embodiment of the present invention, and FIG. 5(*b*) is a front view showing a cathode.
Figure 5B:
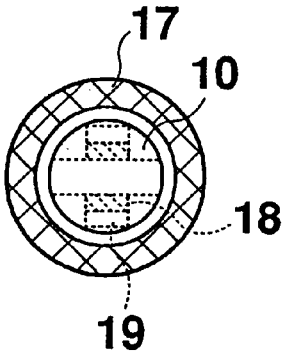

FIGS. 5(*a*) and 5(*b*) show a fourth embodiment of the present invention. In the same manner as in the second embodiment, a cathode 10 is longitudinally interposed between carbon heaters 18.

In the present embodiment, an electric field distribution adjusting cylinder 20 is formed of carbon. As shown in FIG. 5(*a*), only a portion surrounding a thermion emitting face 11 is thick and other portions have a structure in which hollow regions are formed between the electric field distribution adjusting cylinder 20 and an internal wall 22 of an RF electron gun cavity 12. Consequently, it is not necessary to insulate the internal wall 22 of the RF electron gun cavity 12 from the electric field distribution adjusting cylinder 20. And thus manufacture can be performed easily.

FIFTH EMBODIMENT

Figure 6A:
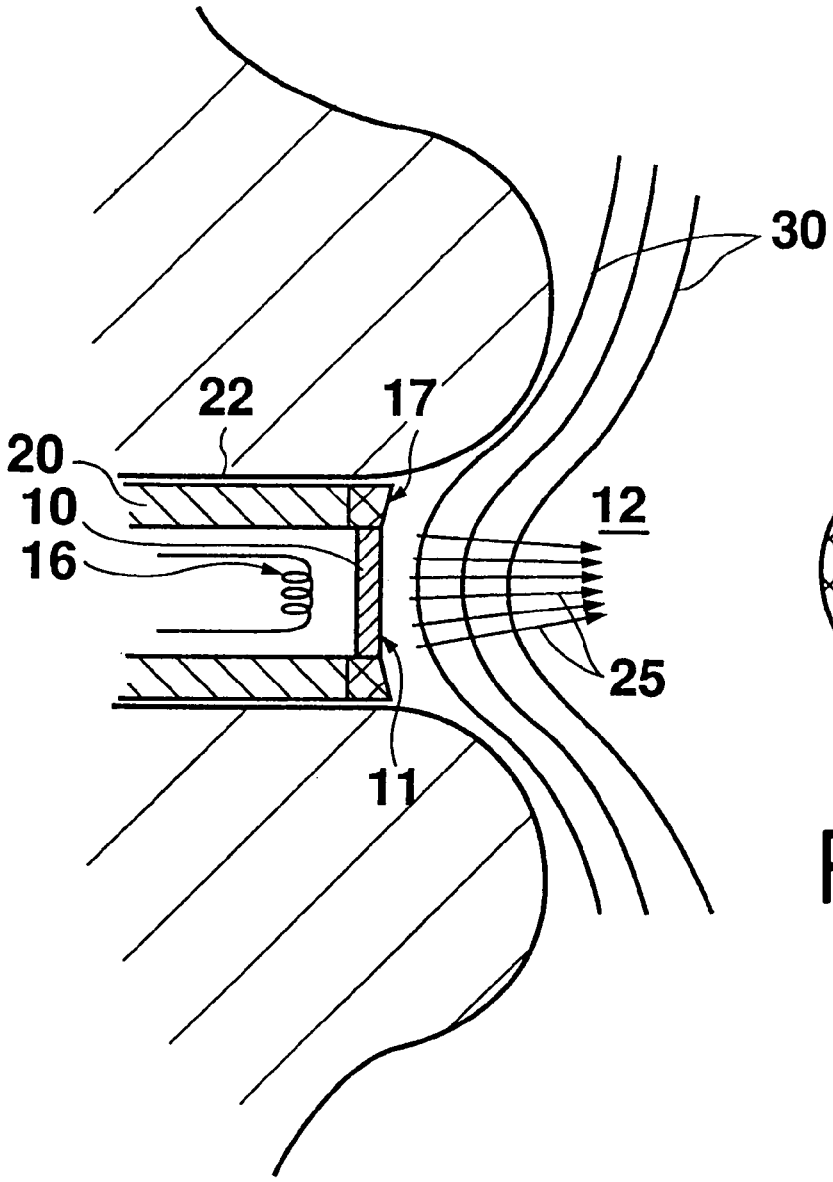
FIG. 6(*a*) is a cross-sectional view showing an electron linear accelerator according to a fifth embodiment of the present invention, and FIG. 6(*b*) is a front view showing a cathode.
Figure 6B:
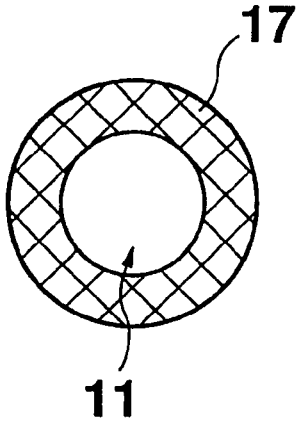
Figure 7A:
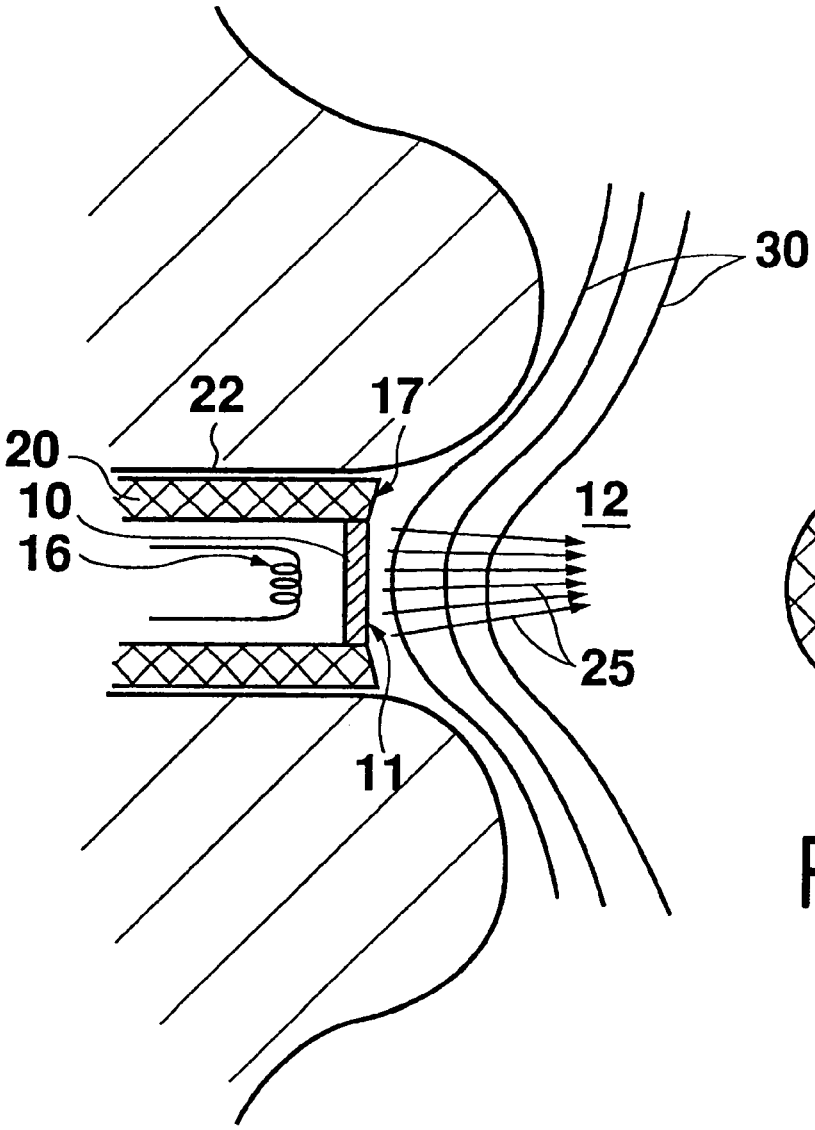
FIG. 7(*a*) is a cross-sectional view showing the electron linear accelerator according to the fifth embodiment of the present invention, and FIG. 7(*b*) is a front view showing the cathode.
Figure 7B:
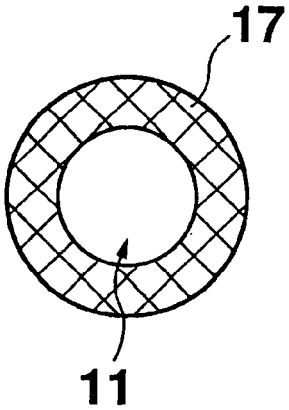

FIGS. 6(*a*) and 6(*b*) and FIGS. 7(*a*) and 7(*b*) show a fifth embodiment of the present invention. In the present embodiment, a surface of the carbon 17 provided on the periphery of a thermion emitting face 11 is tapered in the examples shown in FIGS. 1(*a*) and 1(*b*) or FIGS. 2(*a*) and 2(*b*). By such a structure, an electric field 30 formed ahead of the thermion emitting face 11 is smoothly curved. Consequently, a streamline of the thermion 25 emitted from the thermion emitting face 11 can be caused to converge. Accordingly, beam performance can be enhanced still further.

SIXTH EMBODIMENT

Figure 8A:
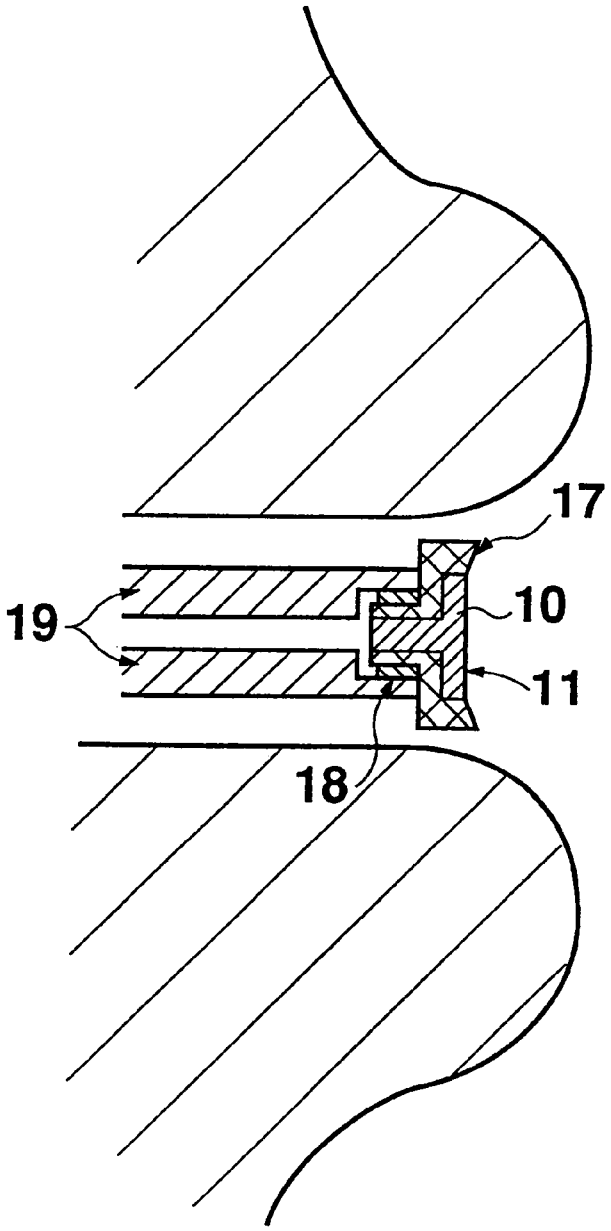
FIG. 8(*a*) is a cross-sectional view showing an electron linear accelerator according to a sixth embodiment of the present invention, and FIG. 8(*b*) is a front view showing a cathode.
Figure 8B:
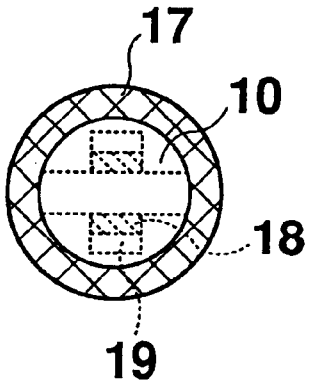

FIGS. 8(*a*) and 8(*b*) show a sixth embodiment of the present invention. In the present embodiment, a surface of carbon 17 provided on the periphery of a thermion emitting face 11 is tapered in the example shown in FIGS. 3(*a*) and 3(*b*). By such a structure, beam performance can be enhanced based on the same principle as the fifth embodiment.

SEVENTH EMBODIMENT

Figure 9A:
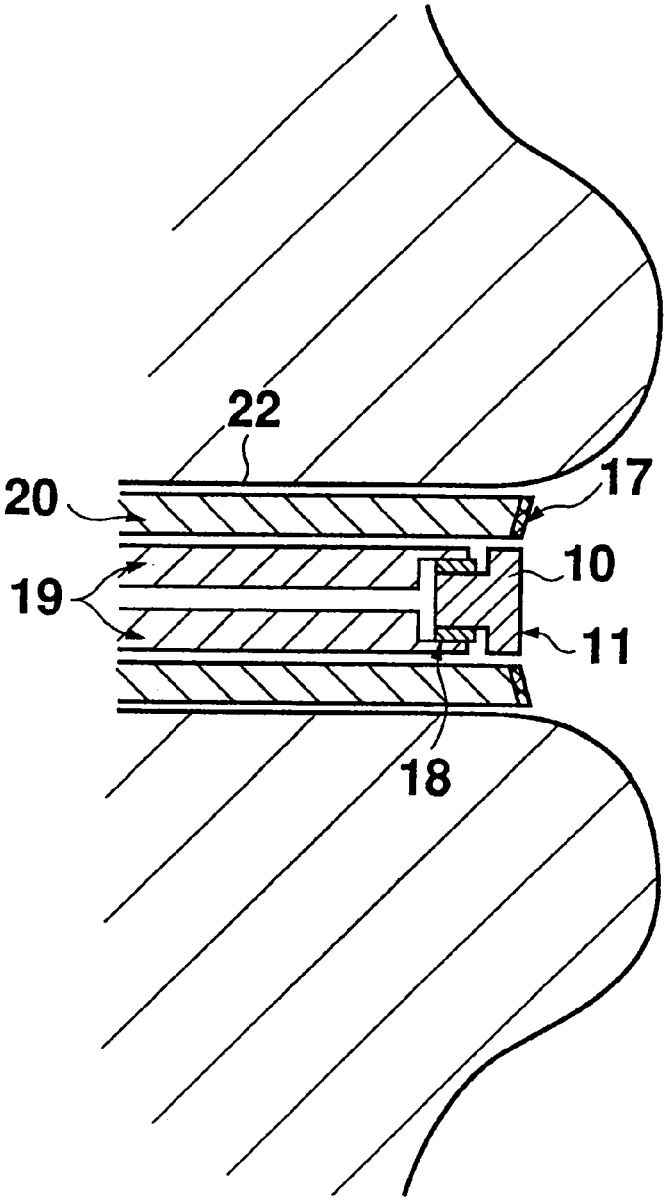
FIG. 9(*a*) is a cross-sectional view showing an electron linear accelerator according to a seventh embodiment of the present invention, and FIG. 9(*b*) is a front view showing a cathode.
Figure 9B:
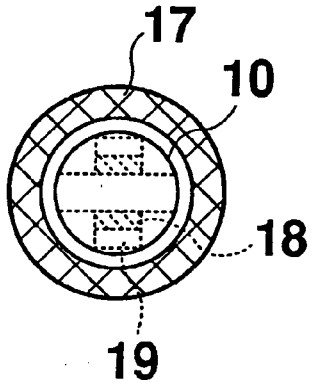

FIGS. 9(*a*) and 9(*b*) show a seventh embodiment of the present invention. In the present embodiment, a tip of an electric field distribution adjusting cylinder 20 is tapered and carbon 17 is formed on a surface of the tip by evaporation, sputtering or the like in the examples shown in FIGS. 4(*a*) and 4(*b*). Accordingly, a surface of the carbon 17 provided on the periphery of a thermion emitting face 11 is also tapered. Thus, beam performance can be enhanced based on the same principle as the fifth embodiment.

EIGHTH EMBODIMENT

Figure 10A:
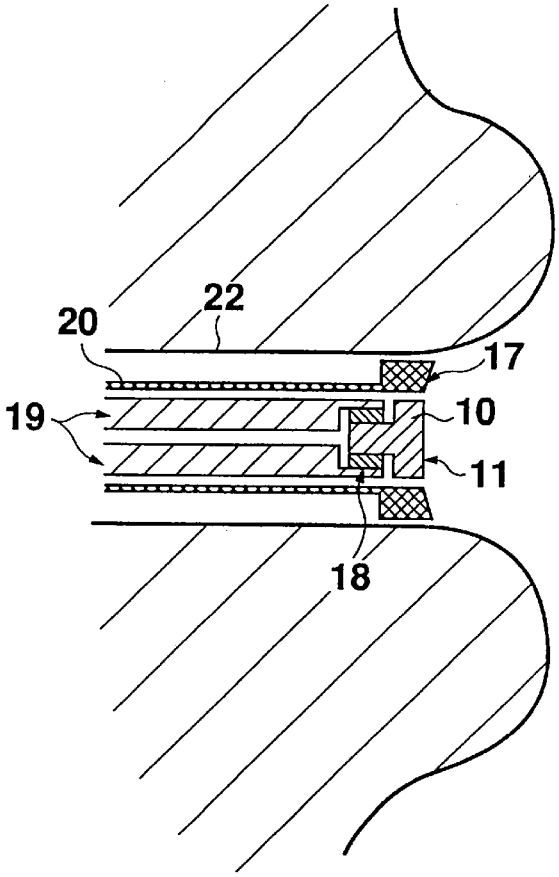
FIG. 10(*a*) is a cross-sectional view showing an electron linear accelerator according to an eighth embodiment of the present invention, and FIG. 10(*b*) is a front view showing a cathode.
Figure 10B:
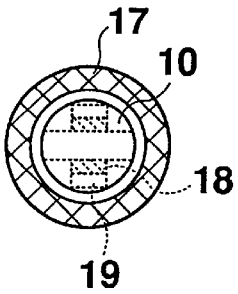

FIGS. 10(*a*) and 10(*b*) show an eighth embodiment of the present invention. In the present embodiment, a surface of carbon 17 enclosing a thermion emitting face 11 is tapered in the examples shown in FIGS. 5(*a*) and 5(*b*). By such a structure, beam performance can be enhanced based on the same principle as the fifth embodiment.

NINTH EMBODIMENT

While a hot-cathode RF electron gun is used in the above-mentioned embodiments, a photocathode RF electron gun for exciting a cathode by means of a laser or the like to generate photoelectrons can also be used so that the same effects can be obtained. Thus, any suitable electron gun can be utilized. In such an embodiment, cathode 10 as shown in FIGS. 1–10 would represent a photocathode, and emitting face 11 would represent a photoelectron emitting face.

According to the present invention described above, the periphery of the thermion emitting face of the cathode is enclosed by the carbon. Therefore, it is possible to properly control the distribution of the electric field formed ahead of the thermion emitting face for leading out thermions. The streamline of the thermions is led to the accelerating tube without divergence. As a result, an electron linear accelerator having enhanced beam performance can be obtained.

Moreover, the surface of the carbon enclosing the thermion emitting face of the cathode is tapered so that a degree of convergence of an electron beam is increased. Consequently, the beam performance can be enhanced still further.

Furthermore, the photocathode RF electron gun can be used as an electron gun. Thus, any suitable electron gun can be utilized.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. In a linear electron accelerator having an RF electron gun including a cathode which has a thermion emitting face, wherein thermions are emitted from the cathode in a direction of an accelerating tube by an electric field, and cathode heating means for heating said cathode, the improvement comprising:

electric field distribution adjusting means for adjusting the distribution of the electric field to be uniform, said electric field distribution adjusting means including carbon material which encloses said thermion emitting face.

2. In a linear electron accelerator as claimed in claim 1, wherein said cathode heating means comprises an indirect cathode filament heater.

3. In a linear electron accelerator as claimed in claim 1, wherein said cathode heating means comprises a pair of direct carbon heaters in direct contact with said cathode.

4. In a linear electron accelerator as claimed in claim 1, wherein said carbon material contacts an end of said cathode, said cathode heating means comprises a pair of direct carbon heaters, said carbon material being interposed between said cathode and said carbon heaters.

5. In a linear electron accelerator as claimed in claim 1, wherein said electric field distribution means is constructed in its entirety of carbon material.

6. In a linear electron accelerator as claimed in claim 1, wherein said carbon material has a tapered shape.

7. In a linear electron accelerator as claimed in claim 1, wherein said carbon material encloses said thermion emitting face on substantially the same plane as said thermion emitting face.

8. A linear electron accelerator, comprising:

a photocathode RF electron gun including a cathode which has a photoelectron emitting face, wherein photoelectrons are emitted from the cathode in response to light excitation in a direction of an accelerating tube by an electric field; and electric field distribution adjusting means for adjusting the distribution of the electric field to be uniform, said electric field distribution adjusting means including carbon material which encloses said photoelectron emitting face.

* * * * *